United States Patent [19]

Hammer et al.

[11] Patent Number: 4,586,955

[45] Date of Patent: May 6, 1986

[54] PROCESS FOR DESULPHURIZING HOT METAL

[75] Inventors: Rudolf Hammer, Dinslaken-Eppinghofen; Walter Meichsner, Krefeld; Karl-Heinz Peters, Dinslaken-Eppinghofen, all of Fed. Rep. of Germany

[73] Assignee: Thyssen Stahl AG, Duisburg, Fed. Rep. of Germany

[21] Appl. No.: 743,854

[22] Filed: Jun. 12, 1985

[30] Foreign Application Priority Data

Jun. 28, 1984 [EP] European Pat. Off. ..... 84107487.5

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS

| | | | |
|---|---|---|---|
| 3,998,625 | 12/1976 | Koros | 75/58 |
| 4,126,453 | 11/1978 | Heck | 75/53 |
| 4,137,072 | 1/1979 | Kawakami | 75/53 |
| 4,462,823 | 7/1984 | Fontaine | 75/58 |

*Primary Examiner*—Peter D. Rosenberg

*Attorney, Agent, or Firm*—Sprung Horn Kramer & Woods

[57] ABSTRACT

The invention relates to a process for desulphurizing hot metal in a ladle, in particular in a torpedo ladle, wherein first aluminum and then, by means of a carrier gas, lime (CaO) are blown into the hot metal. The characterizing feature of the invention is that at a rate of 2–20 liters (S.T.P.) of carrier gas/kg of desulphurizing agent, a solid which evolves a gas in the hot metal is blown in together with the lime.

11 Claims, No Drawings

PROCESS FOR DESULPHURIZING HOT METAL

BACKGROUND OF THE INVENTION

The present invention relates to a process for desulphurising crude iron in a ladle containing the hot metal, in particular in a torpedo ladle, having a submerged lance, wherein first aluminum is added and then, by means of the carrier gas, lime is blown into the hot metal.

The blowing of fine-grain desulphurising agents into hot metal has gained increasing importance in recent years. In this process, mainly agents based on calcium carbide and magnesium are used. Although these desulphurising agents are highly effective, they are relatively expensive.

Since lime is a relatively cheap agent, desulphurising agents based on lime have therefore also been proposed. They have the disadvantage, however, that large quantities are necessary in order to obtain the desired desulphurisation effect. In practice, this leads to considerable difficulties because of the resulting large quantities of slag. The considerable volume of the large quantities of slag in the ladle causes a corresponding reduction in the transport capacity of the ladle. Moreover, the slags tend to deposit on the ladle walls, whereby the transport capacity is yet further restricted. In addition, the slags contain large quantities of iron droplets, which leads to considerable losses of iron.

The desulphurising agent which consists mainly of lime and, in addition, also proportions of 10–40% by weight of alkaline earth metal carbonate or hydroxide, 2–20% by weight of carbon, 2–10% by weight of at least one fluoride selected from the group comprising alkali metal fluorides, alkaline earth metal fluorides, cryolite and sodium silicofluoride, and 0.015–1.0% by weight of a silicone oil surface-active agent, is known from German Patent Specification No. 3.004.973.

In a further development of the use of lime as a desulphurising agent, aluminum is admixed to the desulphurising agent (German Auslegeschrift No. 2.531.047) or first aluminum and then lime are blown into the hot metal by means of high rates of conveying gas. The high rates of a non-oxidising gas, such as, for example, nitrogen, for conveying the lime also serve for dispersing the lime particles in the hot metal and for generating a circulation in the bath. However, this causes considerable disadvantages since, due to incomplete dispersion, the lime cannot deploy its full effect and considerable splashing of the hot metal occurs due to the high conveying gas rates (SDS process of Nippon Steel Corporation). Extensive progressive wear of the refractory lining of the ladle in the inlet region must also be taken into account.

In known desulphurisation processes which operate with lime as the desulphurising agent, the oxygen formed by the reaction $CaO+S=CaS+O$ is bound by the silicon of the hot metal to give $SiO_2$. With the lime blown in, this silica forms dicalcium silicate which surrounds the lime grain with a solid layer. As a result, the desulphurisation effect of the lime grain is adversely effected.

In the known desulphurisation processes with lime, wherein aluminum is additionally blown in to the melt, the oxygen formed by the desulphurisation reaction $CaO+S$ is bound by the aluminum particles blown into the melt, to give $Al_2O_3$. The alumina formed is bound by the lime blown in, to give a layer of calcium aluminates $n.CaO.Al_2O_3$. In contrast to the solid dicalcium silicate, this layer is predominatly in liquid state above 1350° C., having a good desulphurising capacity.

It was the object of the present invention to reduce both the required rate of conveying gas and the consumption of lime-containing desulphurising agent.

SUMMARY OF THE INVENTION

According to the invention this object is achieved when, at a rate 2–20 liters (S.T.P.) of carrier gas/kg of desulphurising agent, a solid which evolves a gas in the hot metal is blown in together with the lime.

It has been found, surprisingly, that the characterising process combination with the aid of the gas-evolving solid and the low conveying gas rate described leads to an excellent desulphurising effect and readily controllable plant application.

The gas-evolving solid consists preferably of an alkaline earth carbonate and/or a alkaline earth hydrate and, with particular advantage, the alkaline earth carbonate blown in is limestone or dolomite and the alkaline earth hydrate blown in is hydrated lime.

On heating in the hot metal these substances spontaneously evolve $CO_2$ or water vapor and effect an intensive dispersion of the grain particles in the hot metal and an intensive circulating flow, which is indispensable for equalising the concentrations, in the hot metal bath.

However, $CO_2$ and water vapor are strongly oxidising at the temperatures of hot metal under thermodynamic aspects. An expert would therefore expect a complete reaction with the aluminum introduced, according to the equations $$2Al+3CO_2=3CO+Al_2O_3$$

or $$2Al+3CO=3C+Al_2O_3$$

or $$2Al+3H_2O=3H_2+Al_2O_3$$

Surprisingly, however, it has been found that the comsumption of desulphurising agent by the process according to the invention can be considerably reduced and that the disadvantages mentioned do not arise. Due to the low conveying gas rates of 2–20, preferably 3–8 liters (S.T.P.)/kg of desulphurising agent, appropriate plant operation is possible. Neither ejection from the torpedo ladle nor significant formation of skull in the ladles occur. The typical wear of the refractory lining at high conveying gas rates is effectively suppressed. Moreover, due to the low conveying gas rate and without impairing desulphurisation reactions, it is possible, according to a further feature of the invention, to use inexpensive compressed air in place of the otherwise required more expensive carrier gases such as nitrogen.

The aluminum is preferably blown in a fine-grain form into the melt by means of a carrier gas. However, it is also possible to introduce the aluminum in the form of wire into the hot metal be means of an appropriate device. Aluminum and the desulphurisation mixture is preferably introduced into the hot metal when the temperature of the hot metal is at least 1350° C.

According to a preferred embodiment of the invention, 0.2–0.7 kg of aluminum per metric ton of hot metal is blown into the hot metal within 1–4 minutes by means of an inert gas, such as, for example, propane, nitrogen or argon. The desulphurisation mixture consists preferably of 40–70% of lime and 30–60% by weight of gas-evolving solid. Preferably, a small proportion of carbon or carbonaceous substances, such as carbon, anthracite, graphite and petroleum coke, in the range of 1–10% by weight are added to the desulphurisation mixture. As a result, the flow properties of the mixture blown in are improved and reducing conditions, as a precondition for good desulphurisation, are enhanced.

The mixture blown in can also contain 1–10% by weight of fluorite. Fluorite ($CaF_2$) lowers the melting point of the aluminates formed, which therefore solidify less readily when the temperature of the melt is lowered. Moreover, the iron content absorbed by the melt is reduced.

The quantity of aluminum and the quantity of desulphurisation mixture here depend on the desired degree of desulphurisation.

For reasons of conveying technology and in order to prevent aluminum fusing to the submerged lance, a flow improver and/or a protective material can also be blown in in together with the aluminum.

In addition to the abovementioned advantages achieved by the invention, the lower quantities of desulphurising agents lead to a reduction in the amount of desulphurisation slag formed and, in connection with this, to a reduction in iron losses. The lower formation of slag leads to a reduced formation of slag deposits in the torpedo ladle and, considered over a long period, has the result that the capacity, of the torpedo is only slightly changed. A further result is that the bath geometry in the torpedo ladle is hardly changed, so that the favorable conditions remain constant over a prolonged period.

The invention is further explained below by reference to the following examples.

EXAMPLE 1

In this comparison example, not covered by the invention, 0.4 kg of aluminum powder per metric ton of hot metal was blown within a period of 3.6 minutes, into 185 metric tons of hot metal in a torpedo ladle of 240 metric tons capacity. The desulphurising agent consisting of lime was then blown in by means of a submerged lance with nitrogen as the conveying gas. The molten hot metal had an initial sulphur content of $S_A=0.035\%$. After a duration of the treatment of 21.7 minutes, 1.170 kg of desulphurising agent had been blown in, and this corresponds to 6.3 kg/metric ton of hot metal. The final sulphur content after the treatment was $S_E=0.015\%$. The conveying gas rate was 75 liters (S.T.P.)/kg of solid, both for blowing the aluminum powder in and for blowing the lime in. The lime delivery rate was 54 kg/minute, due to the required high gas rate. This gives a total blow-in time of 25 minutes.

In spite of the limited ladle charge, considerable splashing of hot metal from the mouth of the torpedo ladle occurred. The submerged lance provided with a thick refractory coating had two nozzle-type outlet orifices and, for this reason, had to be introduced vertically through the mouth orifice of the torpedo ladle.

EXAMPLE 2

In this example according to the invention, 0.2 kg of aluminum powder per metric ton of hot metal was blown, in the first stage, into the melt for a period of 2.5 minutes via a submerged lance with argon as the carrier gas. The weight of the hot metal was 200 metric tons, and the capacity of the torpedo ladle was again 240 metric tons.

In the second stage, the desulphurising agent consisting of 60% by weight of lime, 40% by weight of limestone and 0,05% by weight of flow improver in the form of propyl alcohol was blown into the melt by means of compressed air as the carrier gas. The hot metal had an initial sulphur content of $S_A=0.038\%$, and 700 kg of desulphurising agent had been blown in after 8 minutes duration of the treatment. This corresponds to 3.5 kg/metric ton of hot metal. The final sulphur content after the treatment was $S_E=0.012\%$. The carrier gas rate was 5 liters (S.T.P.) per kg of solid.

The lance used was a simple type which was provided with a thin refractory coating and was immersed obliquely into the hot metal. In spite of the reduction in the blown-in time from 25 to 12 minutes (including the time for blowing the Al in) and a higher charging level of the torpedo ladle, there was no significant ejection of hot metal.

EXAMPLE 3

In this example according to the invention, 0.4 kg of aluminum powder per metric ton of hot metal was blown, in the first stage, into the melt over a period of 4 minutes via a submerged lance with propane as the carrier gas. The weight of hot metal was 181 metric tons, and the capacity of the torpedo ladle was 200 metric tons. In the second stage, the desulphurising agent consisting of 55% by weight of lime, 35% by weight of hydrated lime, 5% by weight of $CaF_2$, 5% by weight of anthracite and 0.03% by weight of a flow improver in the form of a monoglyceride was blown into the melt by means of compressed air as the carrier gas. The hot metal had an initial sulphur content of $S_A=0.015\%$, and after 6.7 minutes duration of the treatment 650 kg of desulphurising agent had been blown in. This corresponds to 3.6 kg/metric tons of hot metal. The final sulphur content after the treatment was $S_E=0.003\%$. The conveying gas rate was 4 liters (S.T.P.) per kg. In this embodiment again a simple tube was used which was provided with a thin refractory coating and was immersed obliquely into the hot metal. The blow-in time was only 10.7 minutes, including the time for blowing the Al in. In this example according to the invention, there was again no significant ejection of hot metal.

We claim:

1. A process for desulphurising hot metal in a ladle which comprises adding aluminum to the hot metal, and then blowing into the hot metal a carrier gas containing lime and a compound which decomposes upon contact with the hot metal thereby generating gas.

2. Process according to claim 1, characterised in that the gas-evolving solid added is an alkaline earth metal carbonate and/or a alkaline earth hydrate.

3. Process according to claim 2, characterised in that the alkaline earth metal carbonate blown in is limestone or dolomite and the alkaline earth hydrate blown in is hydrated lime.

4. Process according to claim 1, characterised in that a mixture consisting of 40–70% by weight of lime and 30–60% by weight of gas-evolving solid is blown into the hot metal.

5. Process according to claim 1, characterised in that a proportion of carbon or carbonaceous substances in the range of 1–10% by weight is added to the mixture which is blown in.

6. Process according to claim 1, characterised in that 1–10% by weight of fluorite is added to the mixture which is blown in.

7. Process according to claim 1, characterised in that the conveying rate is 3–8 liters (S.T.P.) of carrier gas/kg of desulphurising agent.

8. Process according to claim 1, characterised in that the mixture is blown into the molten hot metal by means of compressed air.

9. Process according to claim 1, characterised in that aluminum and the desulphurisation mixture is introduced into the hot metal when the hot metal has a temperature of at least 1350° C.

10. Process according to claim 1, wherein 2–20 liters (S.T.P.) of the carrier gas /kg of desulphurising agent is used for blowing the lime and decomposable solid into the hot metal.

11. Process according to claim 1, wherein the ladle is a torpedo ladle.

* * * * *